US006322272B1

(12) United States Patent
Solis

(10) Patent No.: US 6,322,272 B1
(45) Date of Patent: Nov. 27, 2001

(54) PHOTOGRAPH ALBUM WITH PHOTO SECUREMENT

(76) Inventor: Steve Solis, 16245 E. Edna Pl., Covina, CA (US) 91722

( * ) Notice: Subject to any disclaimer, the term of this patent is extended or adjusted under 35 U.S.C. 154(b) by 0 days.

(21) Appl. No.: 09/489,991

(22) Filed: Jan. 21, 2000

(51) Int. Cl.[7] ..... B42F 13/00

(52) U.S. Cl. ..... 402/79; 281/38; 281/21.1; 40/778

(58) Field of Search ..... 281/38, 21.1, 45, 281/51, 15.1; 402/79; 40/778, 777, 773; 206/455

(56) References Cited

U.S. PATENT DOCUMENTS 3,581,423 * 6/1971 Mascolo ..... 40/158 B
4,263,357 * 4/1981 Holson ..... 40/159 X
4,771,557 * 9/1988 Bowman ..... 40/158.1
6,101,752 * 8/2000 Cumberland ..... 40/778
6,135,663 * 10/2000 Tan ..... 402/79

* cited by examiner

*Primary Examiner*—Willmon Fridie, Jr.
(74) *Attorney, Agent, or Firm*—Goldstein Law Offices, P.C

(57) ABSTRACT

A photograph album with photo securement including an album comprised of an outer cover with a plurality of pages therebetween. Each of the pages includes a rigid back portion and a transparent front portion whereby the front portion can be separated from the back portion. The back portion receives photographs thereon. Each of the photographs has a periphery. A plurality of meltable segments are positionable on the periphery of the photographs and the back portion.

4 Claims, 2 Drawing Sheets

PHOTOGRAPH ALBUM WITH PHOTO SECUREMENT

BACKGROUND OF THE INVENTION

The present invention relates to a photograph album with photo securement and more particularly pertains to keeping photographs in place permanently within an album.

The use of photo albums is known in the prior art. More specifically, photo albums heretofore devised and utilized for the purpose of displaying photographs are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, these patents do not describe a photograph album with photo securement for keeping photographs in place permanently within an album.

In this respect, the photograph album with photo securement according to the present invention substantially departs from the conventional concepts and designs of the prior art, and in doing so provides an apparatus primarily developed for the purpose of keeping photographs in place permanently within an album.

Therefore, it can be appreciated that there exists a continuing need for a new and improved photograph album with photo securement which can be used for keeping photographs in place permanently within an album. In this regard, the present invention substantially fulfills this need.

SUMMARY OF THE INVENTION

In the view of the foregoing disadvantages inherent in the known types of photo albums now present in the prior art, the present invention provides an improved photograph album with photo securement. As such, the general purpose of the present invention, which will be described subsequently in greater detail, is to provide a new and improved photograph album with photo securement which has all the advantages of the prior art and none of the disadvantages.

To attain this, the present invention essentially comprises an album comprised of an outer cover with a plurality of pages therebetween. Each of the pages includes a rigid back portion and a transparent front portion whereby the front portion can be separated from the back portion. The back portion receives photographs thereon. Each of the photographs has a periphery. A plurality of meltable segments are positionable on the periphery of the photographs and the back portion. A heating mechanism is positionable on the meltable segments for melting thereof to secure the photographs to the back portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved photograph album with photo securement which has all the advantages of the prior art photo albums and none of the disadvantages.

It is another object of the present invention to provide a new and improved photograph album with photo securement which may be easily and efficiently manufactured and marketed.

It is a further object of the present invention to provide a new and improved photograph album with photo securement which is of durable and reliable construction.

An even further object of the present invention is to provide a new and improved photograph album with photo securement which is susceptible of a low cost of manufacture with regard to both materials and labor, and which accordingly is then susceptible of low prices of sale to the consuming public, thereby making such a photograph album with photo securement economically available to the buying public.

Even still another object of the present invention is to provide a new and improved photograph album with photo securement for keeping photographs in place permanently within an album.

Lastly, it is an object of the present invention to provide a new and improved photograph album with photo securement including an album comprised of an outer cover with a plurality of pages therebetween. Each of the pages includes a rigid back portion and a transparent front portion whereby the front portion can be separated from the back portion. The back portion receives photographs thereon. Each of the photographs has a periphery. A plurality of meltable segments are positionable on the periphery of the photographs and the back portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
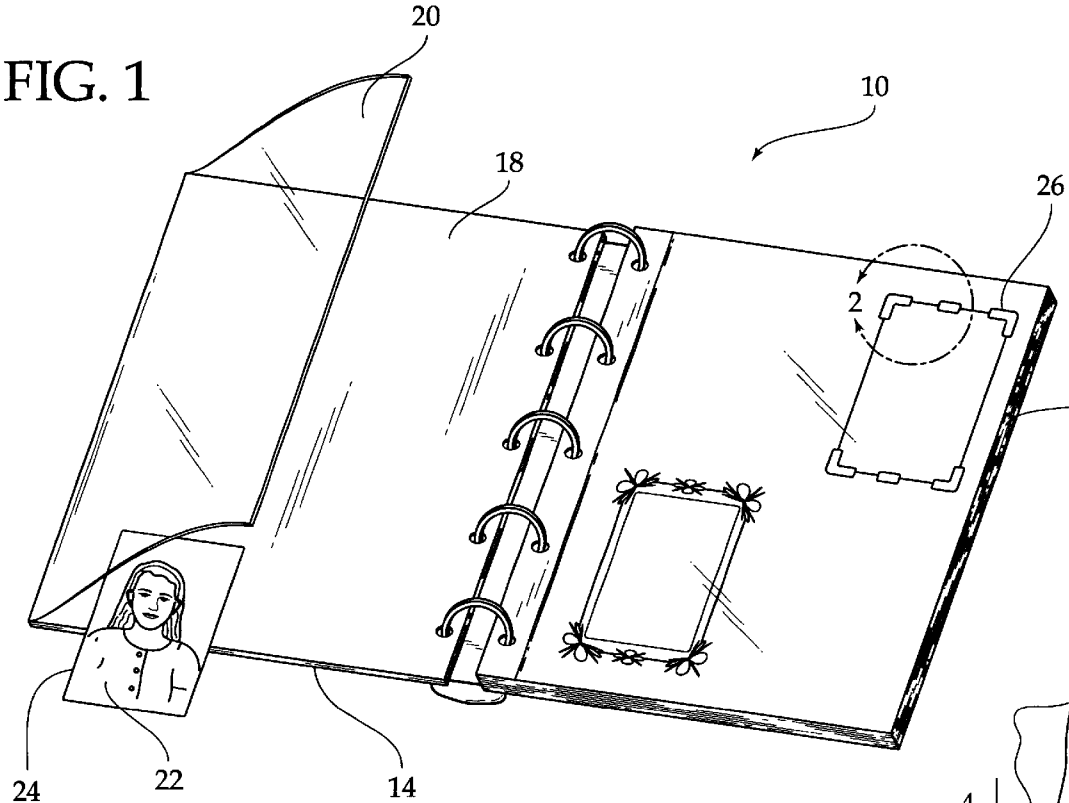
FIG. 1 is a perspective view of the preferred embodiment of the photograph album with photo securement constructed in accordance with the principles of the present invention.

With reference now to the drawings, and in particular, to FIGS. 1 through 4 thereof, the preferred embodiment of the new and improved photograph album with photo securement embodying the principles and concepts of the present invention and generally designated by the reference number 10 will be described.

Specifically, it will be noted in the various Figures that the device relates to a photograph album with photo securement for keeping photographs in place permanently within an album. In its broadest context, the device consists of an album, a plurality of meltable segments, and a heating mechanism. Such components are individually configured and correlated with respect to each other so as to attain the desired objective.

The album 12 is comprised of an outer cover 14 with a plurality of pages 16 therebetween. Each of the pages 16 includes a rigid back portion 18 and a transparent front portion 20 whereby the front portion 20 can be separated from the back portion 18. The back portion 20 receives photographs 22 thereon. Each of the photographs 22 has a periphery 24.

Figure 2:
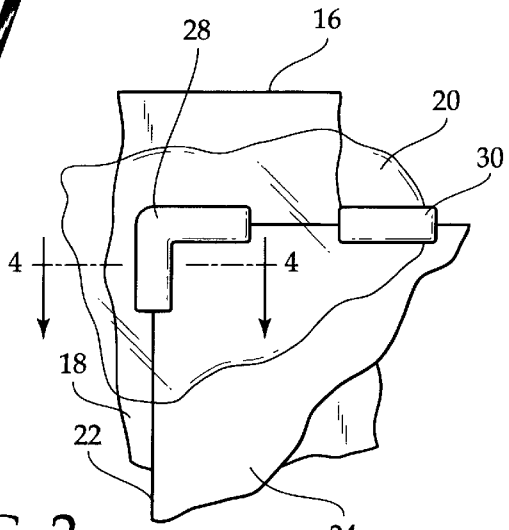
FIG. 2 is a front sectional view as taken from circle 2 of FIG. 1.
Figure 3:
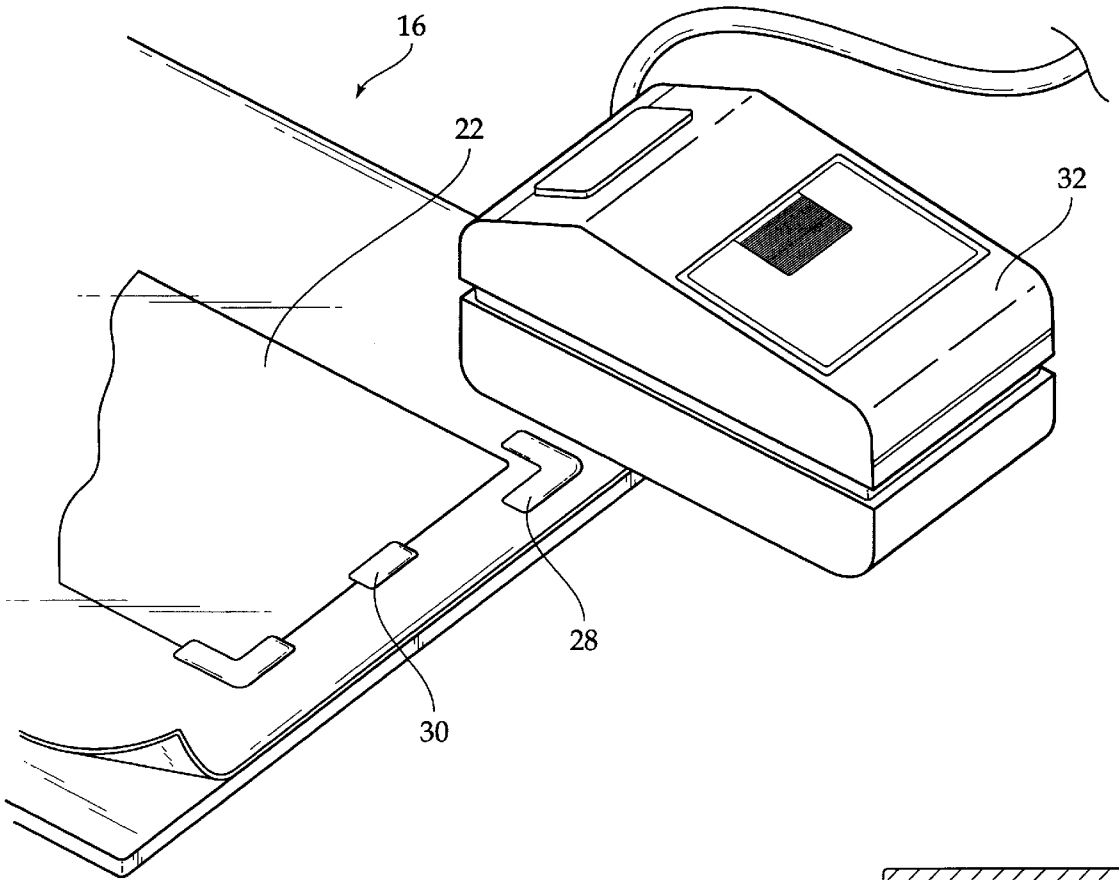
FIG. 3 is a perspective view of the heating mechanism of the present invention.
Figure 4:
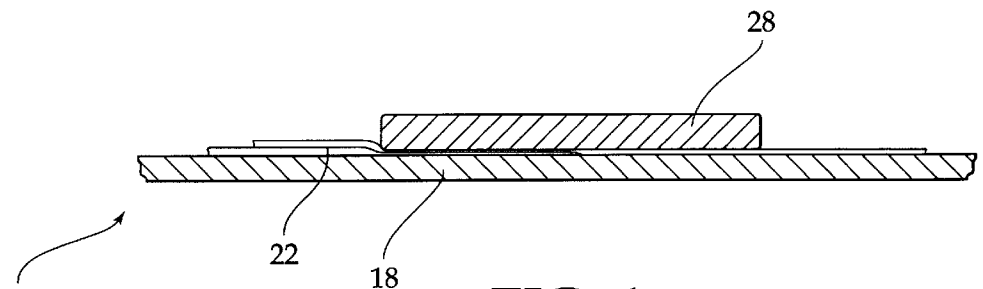
FIG. 4 is a cross-sectional view of the present invention as taken along line 4–4 of FIG. 2.

The plurality of meltable segments 26 are positionable on the periphery 24 of the photographs 22 and the back portion 18. As illustrated in FIGS. 1–3, the meltable segments 26 are constructed in corner forms 28 and straight forms 30.

The heating mechanism 32 is positionable on the meltable segments 26 for melting thereof to secure the photographs 22 to the back portion 16.

In use, the photographs 22 are positioned on the back portion 16, the meltable segments 26 are positioned around the periphery 24 of the photograph 22 and the heating mechanism 32 is positioned on the meltable segments 26. The segments 26 will eventually melt and then harden to secured to photographs to the back portion 16. Once the meltable segments 26 have hardened and cooled, the transparent front portion 20 can be put in place.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A photograph album system with photo securement, for keeping photographs in place permanently within an album, each photograph having a periphery, comprising, in combination:

an album comprised of an outer cover with a plurality of pages therebetween, each of the pages including a rigid back portion and a transparent front portion whereby the front portion can be separated from the back portion, the back portion receiving photographs thereon;

a plurality of meltable segments positionable on the periphery of the photographs and the back portion of the pages;

a heating mechanism selectively positionable on the meltable segments for melting said meltable segments to secure the photographs to the back portion of the pages.

2. A photograph album system with photo securement for keeping photographs in place permanently within an album, each photograph having a periphery, comprising, in combination:

an album comprised of an outer cover with a plurality of pages therebetween, each of the pages including a rigid back portion and a transparent front portion whereby the front portion can be separated from the back portion, the back portion receiving photographs thereon;

a plurality of meltable segments positionable on the periphery of the photographs and the back portion of the pages.

3. The photograph album with photo securement as set forth in claim 2 and further including heating means for selectively melting the meltable segments to secure the photographs to the back portion of the pages.

4. The photograph album with photo securement as set forth in claim 1 wherein the plurality of meltable segments include corner pieces and center pieces.

* * * * *